US009919551B2

(12) United States Patent
Zhou

(10) Patent No.: US 9,919,551 B2
(45) **Date of Patent: *Mar. 20, 2018**

(54) PRINTABLE MEDIUM

(71) Applicant: Hewlett-Packard Development Company, L.P., Fort Collins, CO (US)

(72) Inventor: Xiaoqi Zhou, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/110,524

(22) PCT Filed: Feb. 19, 2014

(86) PCT No.: PCT/US2014/017035

§ 371 (c)(1),
(2) Date: Jul. 8, 2016

(87) PCT Pub. No.: WO2015/126374

PCT Pub. Date: Aug. 27, 2015

(65) Prior Publication Data

US 2016/0332471 A1 Nov. 17, 2016

(51) Int. Cl.
*B41M 5/52* (2006.01)
*B41M 5/50* (2006.01)

(52) U.S. Cl.
CPC ..... *B41M 5/5281* (2013.01); *B41M 5/502* (2013.01); *B41M 5/506* (2013.01); *B41M 5/508* (2013.01); *B41M 5/52* (2013.01); *B41M 5/5218* (2013.01); *B41M 5/5227* (2013.01); *B41M 5/5254* (2013.01); *B41M 5/5263* (2013.01); *B41M 2205/38* (2013.01); *B41M 2205/40* (2013.01)

(58) Field of Classification Search
CPC ..... B41M 5/50; B41M 5/506; B41M 5/508; B41M 5/52; B41M 5/5254; B41M 5/5263; B41M 5/5281; B41M 2205/38; B41M 2205/40
USPC ..... 428/32.16, 32.34, 32.64
See application file for complete search history.

(56) References Cited

U.S. PATENT DOCUMENTS 4,686,260 A 8/1987 Lindemann et al.
4,910,070 A 3/1990 Al'Hariri
(Continued)

FOREIGN PATENT DOCUMENTS

CN 101233201 7/2008
EP 1586447 10/2005
(Continued)

OTHER PUBLICATIONS

International Search Report dated Nov. 12, 2014 for PCT/US2014/017035, Applicant Hewlett-Packard Development Company, L.P.

*Primary Examiner* — Bruce H Hess
(74) *Attorney, Agent, or Firm* — HP Inc. Patent Department

(57) ABSTRACT

A printable medium with a printable medium comprising a composite supporting substrate having a first fabric layer and a second layer containing fibers laminated to the first layer; an image receiving layer coated on the second layer; and an external layer, coated over the image receiving layer, comprising, at least, two polymeric networks and polymeric particles. Also disclosed are the method for making such printable medium and the method for producing printed images.

15 Claims, 2 Drawing Sheets

(56) References Cited

U.S. PATENT DOCUMENTS

| | | | |
|---|---|---|---|
| 5,700,575 | A | 12/1997 | Iwata et al. |
| 5,866,258 | A | 2/1999 | Lucas |
| 6,409,333 | B1 | 6/2002 | Nishikawa |
| 6,953,624 | B2 | 10/2005 | Bacon, Jr. |
| 8,556,411 | B2 | 10/2013 | Niu |
| 8,563,100 | B1 | 10/2013 | Zhou et al. |
| 2005/0100687 | A1 | 5/2005 | Dutton et al. |
| 2006/0003115 | A1 | 1/2006 | DeMejo et al. |
| 2006/0089453 | A1 | 4/2006 | Pajerski |
| 2009/0111039 | A1 | 4/2009 | Kronzer |
| 2011/0250368 | A1 | 10/2011 | Shih et al. |

FOREIGN PATENT DOCUMENTS

| | | |
|---|---|---|
| KR | 20140020196 | 2/2014 |
| WO | WO-2007015264 | 2/2007 |
| WO | 2007046602 | 4/2007 |
| WO | 2008149067 | 12/2008 |
| WO | 2009038314 | 3/2009 |
| WO | 2014014453 | 1/2014 |

PRINTABLE MEDIUM

BACKGROUND

Inkjet printing technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of medium substrates. Inkjet printing technology has found various applications on different substrates including, for examples, cellulose paper, metal, plastic, fabric, and the like. The substrate plays a key role in the overall image quality and permanence of the printed images.

Large format print medium becomes more and more popular and finds use in many applications such as wall coverings, banners, and signs of many types that can be printed to create images with one or more symbols, text and photographs. When printing on such substrates, challenges exist due to their specific nature. Durability of the image printed thereon is often in consideration. Accordingly, investigations continue into developing medium substrates that can be effectively used for large format printing which can be used a wall covering substrate, for examples, and which can impart good mechanical resistance.

BRIEF DESCRIPTION OF THE DRAWINGS

The drawings illustrate various embodiments of the present printable medium and are part of the specification.

DETAILED DESCRIPTION

Figure 1:
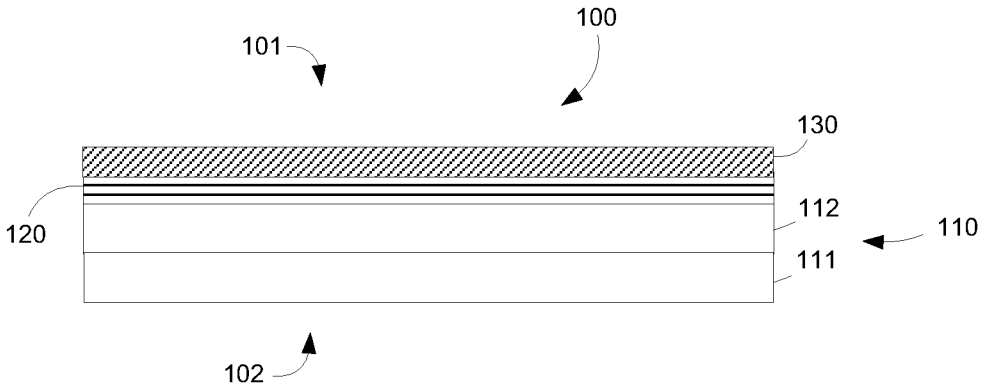
FIGS. 1 and 2 are cross-sectional views of the printable medium according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to a printable medium comprising a composite supporting substrate having a first fabric layer and a second layer, containing fibers, laminated to the first layer; an image receiving layer coated on the second layer; and an external layer, coated over the image receiving layer, comprising, at least, two polymeric networks and polymeric particles. The present disclosure also refers to a method for making such printable medium and to a method for producing printed images using said printable medium.

The printable medium, as disclosed herein, can be used as a wall covering material (e.g., wallpaper) for home or commercial use, for decoration or display as well as signs or banners and the like. In some examples, the printable medium of the present disclosure is a wall covering substrate. The composite base substrate, that is part of the printable medium, includes laminated layers that form a non-image side and an image side on the printable medium. The non-image side, or backside, is the side that would face and attach to a wall, in a wall covering application, or even in a sign or banner application having a single image side. The image side is the side that includes material layers to receive, support and protect an image.

The term "wall covering," as used herein, means a large format print medium that has a length that is much larger than a width (or vice versa) relative to small format office paper or photo media products (e.g., letter, A4, legal, etc. sizes). For example, the wall covering may be provided in a roll that is 1.37 meters (54 inches) wide and 27.43 meters (30 linear yards) long. Moreover, the term "wall covering" means a print medium that supports various imaging materials and applications, for example, various types of inkjet inks and inkjet printing, for image formation, including digital printing. In addition, the term "wall covering" means a product that complies with federal and industry standards or specifications for wall coverings including, but may not be limited to, CCC-W-408A and D, ASTM F793 and CFFAW-101D. Under these standards, wall coverings have weight and durability requirements depending on which category or type that the wall covering falls within. Category I is for decorative only wall covering, while Category VI is for commercial serviceability wall covering. (Types I, II and III wall coverings are substantially equivalent to Categories, IV, V and VI, respectively, among the standards). The wall covering according to the principles described herein has wear and tear durability of Type-II, or possibly higher grade, wall coverings in accordance with the aforementioned standards and may meet or exceed established criteria for Type-II wall coverings under the aforementioned standards. By "wear and tear", it is meant the minimum scrubbability standard and the minimum breaking strength standard, respectively, of ASTM F793. Herein, the term "wall covering," "wall covering print medium," and "wall covering digital print medium" may be used interchangeably.

The printable medium of the present disclosure, when used as a wall covering, have a durability that may meet or exceed Type-II wall covering standards or specifications identified herein. In addition, the printable medium of the present disclosure is able to provide a durable Type-II wall covering and is also free of polyvinyl chloride (PVC), which is harmful to the environment. In some examples, the printable medium, when used a wall covering in an indoor environmental, is able to meet "Fire Resistance or flame resistance" standards such as ASTM E84 for example.

In some examples, the printable medium, when used in a wall covering application, has a mechanical breaking strength that is within a range of at least 50 lb to about 60 lb; or within a range of about 55 lb to about 60 lb. The mechanical breaking strength in the Machine Direction (MD) can be between about 58 lb and about 60 lb and in the Cross Machine Direction (CMD) can be between about 55 lb to about 58 lb. Such measurements are made according to the ASTM D751 "Standard test method for coated fabrics". In some other examples, the printable medium, when used in a wall covering application, can have a minimum scrubbability resistance of 300 cycles, or maybe more, of linear abrasion. Such measurements are made according to the ASTM F793 "Standard test method for coated fabrics".

The printable medium can be an inkjet printable medium. The printable medium can thus be specifically designed to receive any inkjet printable ink, such as, for example, organic solvent-based inkjet inks or aqueous-based inkjet inks Examples of inkjet inks that may be deposited, established, or otherwise printed on the printable medium, include pigment-based inkjet inks, dye-based inkjet inks, pigmented latex-based inkjet inks, and UV curable inkjet inks FIG. 1 schematically illustrates an example of the printable medium (100) of the present disclosure. It is to be understood that the thickness of the various layers is exaggerated for illustrative purposes. The printable recording medium (100) has an image or printed side (101) and a backside or opposing side (102). The image side (101) of the medium is the side that includes material layers that will receive, support and protect an image. The backside, or opposing side, (102) is not designed for receiving printing image and is the side that would face and attach to a subject such as a panel, a board and a wall surface in a wall covering application, or even in a sign or banner application having a single image side.

Figure 2:
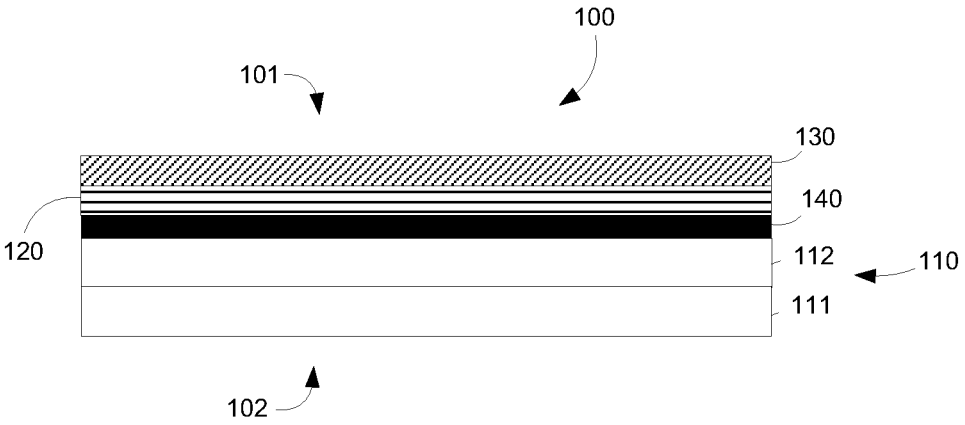

As illustrated in FIG. 1, the printable recording medium (100) encompasses a composite supporting base substrate (110), above which is applied an image receiving layer (120). The image receiving layer (120) is applied, only, on one side of the supporting composite base substrate (110). The printable recording medium (100) includes a composite supporting base substrate (110) that comprises a first fabric layer (111) and a second layer containing fibers (112) laminated to the first layer (111). The non-image side (102) of the composite supporting base substrate (110) is a back side of the first layer (111). The image side (101) of the composite supporting base substrate (110) is the front side of the second fiber layer (112). FIG. 2 illustrates a side view of another example of the printable recording medium (100) structure in accordance with the examples described herein. The composite supporting base substrate (110) of the printable recording medium (100) includes a first fabric layer (111), a second layer (112) laminated to the first layer (111), and a tie layer (140) directly applied on the second layer (112). As illustrated in FIG. 1, the printable recording medium (100) includes an image receiving layer (120) coated on the image side of the composite supporting base substrate (110). As illustrated in FIG. 2, the image receiving layer (120) is coated over the tie layer (140). As illustrated in FIGS. 1 and 2, the printable recording medium (100) further includes an external coated layer (130) coated on the image receiving layer (120). In FIG. 2, the image receiving layer (120) of the printable recording medium (100) is associated with the tie layer (140) on the front side of the second layer containing fibers (112).

Figure 3:
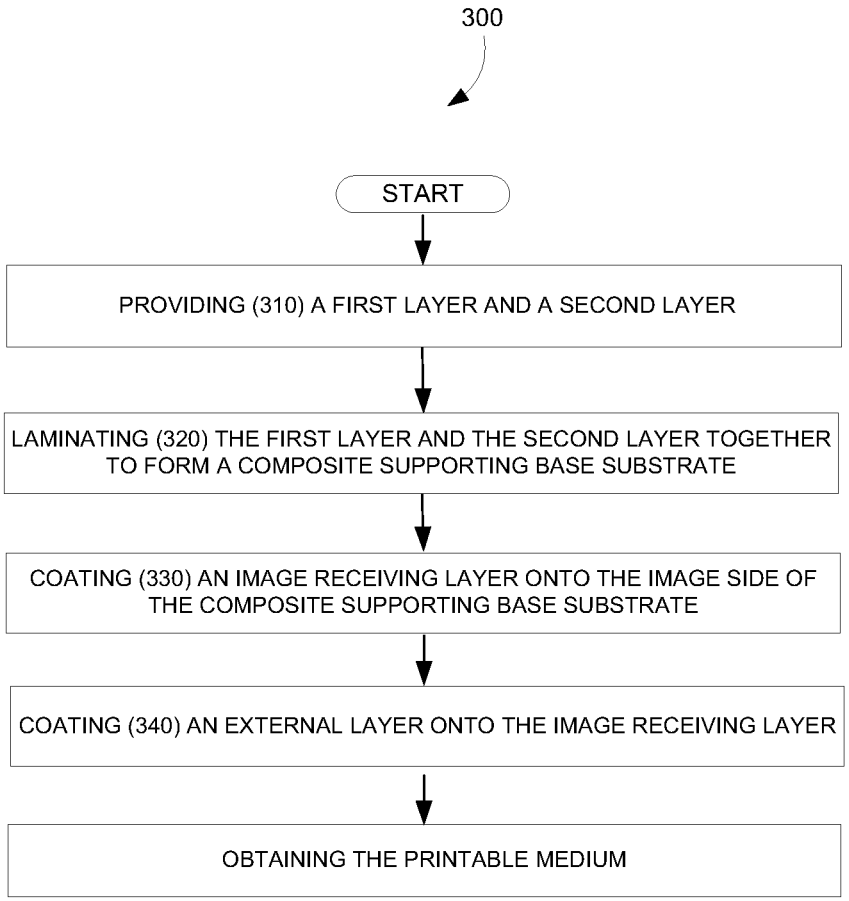
FIG. 3 is a flowchart illustrating the method for making the printable medium according to some embodiments of the present disclosure.

FIG. 3 is a flowchart illustrating methods of making the printable recording medium such as described herein. Such method (300) encompasses: providing (310) a first fabric layer (111) and a second layer containing fibers (112); laminating (320) the first fabric layer (111) and the second layer (112) together to form a composite supporting base substrate (110); coating (330) an image receiving layer (120) onto the image side of the composite supporting base substrate (110); and, then, coating (340) an external layer (130) onto the image receiving layer (120).

The printable medium (100) has a composite supporting substrate (110) that has a first fabric layer (11) and a second fiber layer (112), containing polymeric fiber, laminated to the first layer. The printable medium further comprises an image receiving layer (120) coated on the second layer and an external layer (130), coated over the image receiving layer that contains, at least, two polymeric networks and polymeric particles. The printable medium (and the composite base substrate) has an image side (101) and a non-image side (102). The non-image or backside (102) of the printable medium (100) is the side that would face and attach to a wall in a wall covering application, or even in a sign or banner application having a single image side. The image side (101) of the printable medium (100) is the side that will receive, support and protect a printed image.

Composite Base Substrate

The printable medium encompasses a composite supporting base substrate (110), with an image side (101) and a back side (102) (or non-image side), the composite supporting substrate having a first fabric layer and a second layer containing fibers that is laminated to the first layer. The composite supporting base substrate (110) (or composite supporting substrate or composite structure) includes laminated layers that form a non-image side and an image side of the composite supporting substrate. The word "supporting" refers herein to a substrate where the printing image can be formed on at least one side of the substrate, i.e. the image side (101), via an image receiving coating deposited on the surface of the support. The word "supporting" also refers to a physical objective of the substrate which is to carry the image with any desired geometry and size with excellent durability or mechanical strength. The word "composite" refers herein to a material made from at least two constituent materials, or layers, that have different physical and/or chemical properties from one another, and wherein these constituent materials/layers remain separate at a molecular level and distinct within the structure of the composite. The "composite structure", as used herein, is the support or substrate of the printable medium supports wall covering material layers including, but not limited to, one or more of imaging receiving, imaging, protective materials layers, as well as adhesive materials coated as separate layers onto the composite structure. Moreover, the composite supporting base substrate (110) supports a wall covering when applied or attached to a surface or wall in a variety of applications and environments, for example, high moisture and high abrasion environments. The composite supporting substrate is a laminated structure. The "laminated", as used herein, reflect the fact that the layers or compounds have been applied to each other using a lamination process. In some examples, the composite further includes an adhesive constituent layer laminated between two other constituent layers.

The image side of the composite supporting base substrate (110) supports material layers coated on the surface of the second layer (112) in order to facilitate an image to be formed on the image side. As such, the second fiber layer (112) is a smooth material that further may be flat to receive the coating layers. By "smooth", it is meant that the surface roughness of the second layer is no greater than about 5 microns by PPS method (i.e., Parker Print Surf method). In some examples, the surface roughness by PPS method of the second fiber layer (112) is no greater than 4 microns, or no greater than 2 microns, or no greater than about 0.5 microns.

In some examples, the composite supporting base substrate (110) is durable and flexible support. By "durable", it is meant that the composite supporting substrate has a high tolerance to certain physical forces and surface degradation forces. The durability of the composite supporting substrate is manifested according to one or more of tear and tensile strength, surface abrasion, water and solvent resistance, fire resistance, dimensional stability, stain resistance, heat ageing, cold climate, and others described in the wall covering classification standards ASTM F793 and Federal Specification CCC-W-408D, for example, for Type II commercial serviceability wall coverings. The composite supporting base substrate (110) may be porous or non-porous, and may be substantially flexible. By "flexible", it is meant pliant or pliable and able to be rolled and unrolled without breaking or cracking, for example.

The First Fabric Layer of the Composite Supporting Base Substrate

The first fabric layer (111) of the composite supporting base substrate (110) is a fabric substrate. The term "fabric", as used herein, is intended to mean a textile, a cloth, a fabric material, fabric clothing, or another fabric product that has mechanical strength and air permeability. The term "fabric structure" is intended to mean a structure having warp and weft that is woven, non-woven, knitted, tufted, crocheted, knotted or pressed, for example. The terms "warp" and "weft" refers to weaving terms that have their ordinary means in the textile arts. As used herein, warp refers to lengthwise or longitudinal yarns on a loom, while weft refers to crosswise or transverse yarns on a loom. The first fabric layer (111) of the composite supporting substrate includes a fabric having warp and weft to facilitate airflow on the non-image side. Airflow refers to one or both of through a thickness of the fabric (e.g., z direction) and along an interface between the fabric and a surface, such as a wall, to which the non-image side of the fabric is to be attached (e.g., x and y directions). Without behind linked by any theory, it is believed that adequate airflow helps to prevent formation of some detrimental biological growth, such as mold and mildew formation. Adequate airflow may be validated by two separate methods. A first method uses fluid-flow measurements per ASTM E96, which determines the relative water-vapor transmission rate through a medium. A second method is per ASTM D6329 in combination with UL GreenGuard Test Method P040, which determines an ability of the medium to grow and sustain mold and mildew formations.

The first fabric layer (111) has a fabric structure that includes, but is not limited to, one of woven, non-woven, knitted and tufted; and has a fabric surface that may be one of flat or exhibits pile. Moreover, the fabric structure may have a surface roughness or texture to form airflow channels or pathways at the interface with the wall surface to which the fabric is to be attached to facilitate airflow. The fabric may have one or both mechanical strength properties and air permeability properties. The fabric of the first fabric layer (111) of the composite supporting substrate (110) can be a woven, non-woven, knitted or tufted fabric structure. In some examples, the fabric of the first fabric layer is a woven textile including, but not limited to, satin, poplin, and crepe weave. In some other examples, the first fabric layer is a knitted textile including, but not limited to, circular knit, warp knit, and warp knit with a micro denier face.

The fabric can be a woven fabric where warp yarns and weft yarns are mutually positioned at an angle of about 90°. This woven fabric includes, but is not limited to, fabric with a plain weave structure, fabric with twill weave structure where the twill weave produces diagonal lines on a face of the fabric, or a satin weave. For example, the direction of the diagonal lines of the twill weave, as viewed along a warp direction, may be up to the right or to the left making a Z or S twill. Compared to plain weave (of the same cloth parameters) twills have longer floats, fewer intersections and a more open construction to help air flow. In contrast to twill weave, the satin weave has a smooth fabric surface free from twill lines by making the distribution of interlacing points between the weft yarns and the warp yarns as random as possible to avoid twill lines. For example, by 'interlacing points' it is meant a number of weft yarns float over a single warp yarn, or vice versa, i.e., a number of warp yarns float over a single weft yarn. In some examples of satin weave, the interlacing points repeat by 5, or by 6, or by 7, or by 8.

The fabric can also be a knitted fabric with a loop structure including one or both of warp-knit fabric and weft-knit fabric. The weft-knit fabric refers to loops of one row of fabric are formed from the same yarn. The warp-knit fabric refers to every loop in the fabric structure is formed from a separate yarn mainly introduced in a longitudinal fabric direction. In some examples, the fabric of the first layer is a non-woven product, for example a flexible fabric that includes a plurality of fibers or filaments that are one or both of bonded together and interlocked together by a chemical treatment process (e.g., a solvent treatment), a mechanical treatment process (e.g., embossing), a thermal treatment process, or a combination of two or more of these processes.

The first fabric layer (111) can comprise one or both of natural fibers and synthetic fibers. Natural fibers that may be used in the fabric of the first layer include, but are not limited to, wool, cotton, silk, linen, jute, flax, or hemp. Additional fibers that may be used include, but are not limited to, rayon fibers, or those of thermoplastic aliphatic fibers derived from renewable resources, including, but not limited to, corn starch, tapioca products, or sugarcanes. These additional fibers are also referred to herein as "natural" fibers for simplicity of discussion. In some examples, the fiber used in the first layer includes a combination of two or more from the above-listed natural fibers, a combination of any of the above-listed natural fibers with another natural fiber or with synthetic fiber, a mixture of two or more from the above-listed natural fibers, or a mixture of any thereof with another natural fiber or with synthetic fiber.

The synthetic fiber that may be used in the fabric of the first layer is polymeric fiber including, but not limited to, polyvinyl chloride (PVC)-free fibers made of polyester, polyamide, polyimide, polyacrylic, polypropylene, polyethylene, polyurethane, polystyrene, polyaramid, e.g., Kevlar®, polytetrafluoroethylene, e.g., Teflon® (both trademarks of E. I. du Pont de Nemours and Company), fiberglass, polytrimethylene, polycarbonate, polyester terephthalate, or polybutylene terephthalate. In some examples, the fiber used in the first fabric layer includes a combination of two or more of the fibers, a combination of any of the fibers with another polymeric fiber or with natural fiber, a mixture of two or more of the fibers, or a mixture of any of the fibers with another polymer fiber or with natural fiber. In some examples, the synthetic fiber includes modified fibers. The term 'modified fibers' refers to one or both of the polymeric fiber and the fabric as a whole having undergone a chemical or physical process such as, but not limited to, one or more of a copolymerization with monomers of other polymers, a chemical grafting reaction to contact a chemical functional group with one or both the polymeric fiber and a surface of the fabric, a plasma treatment, a solvent treatment, for example acid etching, and a biological treatment, for example an enzyme treatment or antimicrobial treatment to prevent biological degradation. The term "PVC-free" means no polyvinyl chloride (PVC) polymer or vinyl chloride monomer units present in the wall covering or the composite supporting substrate.

The first fabric layer (111) of the composite supporting substrate (110) can contain both natural fibers and synthetic fibers. In some examples, the amount of synthetic fibers represents from about 20% to about 90% of the total amount of fibers. In some other examples, the amount of natural fibers represents from about 10% to about 80% of the total amount of fibers. In some other examples, the first fabric layer (111) of the composite supporting substrate (110) comprises natural fibers and synthetic fibers in a woven structure, the amount of natural fibers is about 10% of a total fiber amount and the amount of synthetic fibers is about 90% of the total fiber amount.

The first fabric layer (111) of the composite supporting substrate (110) may contain additives including, but not limited to, one or more of colorant (e.g., pigments, dyes, tints), antistatic agents, brightening agents, nucleating agents, antioxidants, UV stabilizers, fillers, flame retardants, and lubricants, for example. The additives are included to improve various properties of the fabric.

The Second Layer of the Composite Supporting Base Substrate

The second layer (112) of the composite supporting base substrate (110), also called second fiber layer (112), contains fibers. In some examples, the second layer (112) contains fibers which are sourced from natural wood species only and include fibers from recycling pulps (i.e. wood fiber base) (no polymer fiber). In some other examples, the second layer (112) contains fibers. The second layer (112) can contain a synthetic polymeric fiber as a first constituent material and a natural fiber as a second constituent material. The amount of synthetic polymeric fiber can be within a range of about 5 wt % to about 80 wt %; or can be within a range of about 10 wt % to about 30 wt % by weight of total fibers in the second layer.

In some examples, the second fiber layer (112) contains a synthetic polymeric fiber as a first constituent material and a natural cellulose fiber as a second constituent material, the amount of synthetic polymeric fiber in the fiber composition is within a range of about 5% to about 80% by weight of total fibers.

The second fiber layer (112) of the composite supporting base substrate (110) may comprise a PVC-free synthetic polymeric component that is one of synthetic polymeric fiber in a non-woven structure and a synthetic polymeric film. In some examples, the synthetic polymeric fiber can be selected from the group consisting of polyolefins, polyamides, polyesters, polyurethanes, polycarbonates, polyacrylics, a combination of two or more of the fibers, and a mixture of two or more of the fibers. The synthetic polyolefin fiber may include, but is not limited to, polyethylene fiber, polyethylene copolymer fiber, polypropylene fiber, polypropylene copolymer fiber, a combination of two or more of the polyolefin fibers, a combination of any of the polyolefin fibers with another polymeric fiber, mixtures of two or more of the polyolefin fibers, or mixtures of any of the polyolefin fibers with another polymer fiber. In some examples, the fiber composition may include a synthetic cellulosic material including, but not limited to, cellulose diacetate, cellulose triacetate, cellulose propionate, cellulose butyrate, cellulose acetate butyrate and nitrocellulose.

The fiber composition can be used to form a web of the second layer having the non-woven structure, for example, using paper making equipment. The synthetic polymeric fiber of the second layer may have an average length within a range of about 1 millimeter (mm) to about 3 mm. This length is comparable to the length of natural cellulose fibers. In some examples, the synthetic polymeric fiber has a length greater than 3 mm, provided that the synthetic polymeric fiber does not negatively impact the formation of the second layer using the paper making equipment, for example on a screen of a paper mill. In some other examples, the synthetic polymeric fiber has diameter within a range of about 10 micrometers or microns (μm) to about 40 μm with an average length within a range of about 2 mm and about 3 mm. The amount of the synthetic polymeric fiber in the second layer depends on the length of the fiber. For example, the use of longer synthetic fibers may allow for improvement in dimensional stability of the composite supporting substrate with lower amounts of the synthetic fibers being used.

As indicated above, the fiber composition of the second layer (112) of the composite supporting substrate (110) may comprise both synthetic fibers and natural fibers. The natural fiber includes natural cellulose fiber from either hardwood species or hardwood species and softwood species. In some examples, a ratio of hardwood fiber to softwood fiber in the second layer can be within a range of about 100:0 to about 50:50. The natural cellulose fiber may be processed into various pulps including, but not limited to, wood-free pulp, such as bleached or unbleached Kraft chemical pulp and bleached or unbleached sulfite chemical pulp; wood-containing pulp, such as one or more of ground wood pulp, thermo-mechanical pulp, and chemo-thermo-mechanical pulp; pulp of non-wood natural fiber, such as one or more of bamboo fiber, bagasse fiber, recycled fiber, cotton fiber; a combination of two or more pulps, or a mixture of two or more of pulps. An amount of synthetic polymeric fiber in the second layer fiber composition that further includes natural fiber may be within a range of about 10 wt % to about 80 wt % by weight of total fiber. In some examples, the amount of synthetic polymeric fiber by weight of total fiber in the second layer fiber composition is about 20 wt % to about 70 wt %, or about 30 wt % to about 60 wt %.

The synthetic polymeric component of the second layer (112) of the composite supporting base substrate (110) can be a PVC-free synthetic polymeric film of high molecular weight. By 'high molecular weight', it is meant a weight average molecular weight ($M_W$) that is greater than $1\times10^4$ grams per mole (g/mol). The synthetic polymeric film may be made from a non-vinyl chloride polymer including, but not limited to, one or both of homopolymers and copolymers of polyethylene (PE), polypropylene (PP), nylon (polyamides), polystyrene, acrylonitrile butadiene styrene (ABS), polycarbonate, a combination of two or more thereof, or a mixture of two or more thereof. By 'non-vinyl chloride polymer' it is meant that there is no polyvinyl chloride (PVC) existing in the synthetic polymeric film, or that the synthetic polymeric film contains no vinyl chloride chain units (i.e., a PVC-free film), since polyvinyl chloride is known to be harmful to the environment, as mentioned above.

The synthetic polymeric component can be a polypropylene film having a weight average molecular weight ($M_W$) within a range of about $2.90\times10^5$ g/mol to about $3.95\times10^5$ g/mol, as measured by gel permeation chromatography (GPC) calibrated with a polystyrene standard. The molecular weight distribution as presented by $M_w/M_n$, where $M_n$ is the number average molecular weight, ranges from about 2.9 to about 4.8 for this example. Moreover in this example, the polypropylene film may be either uni-oriented or biaxially oriented with a density of about 0.85 g/cm$^3$ for amorphous area and of about 0.94 g/cm$^3$ for crystalline area. Also, the polypropylene film may have a melt point that may be within a range of about 140° C. to about 185° C.

The second layer (112) of the composite supporting base substrate (110) forms a film that can have a thickness within a range of about 40 microns to about 300 microns. In some examples, the thickness of the synthetic polymeric film of the second layer is within the range of about 60 microns to about 200 microns, or about 80 microns to about 150 microns. The second layer (112) of the composite supporting base substrate (110) forms a film that can have a density in a range of about 0.50 grams per cubic centimeter (g/cm$^3$) to about 1.2 g/cm$^3$. In some other examples, the density of the second layer is within the range of about 0.60 g/cm$^3$ to about 1.0 g/cm$^3$, or about 0.75 g/cm$^3$ to about 0.90 g/cm$^3$.

In some examples, the second layer (112) is a synthetic polymeric film having a thickness within a range of about 40 microns to about 300 microns and a density within a range of about 0.50 gram per cubic centimeter (g/cm$^3$) to about 1.2 g/cm$^3$, the synthetic polymeric film being one or both of homopolymers and copolymers of high molecular weight selected from the group consisting of polyethylene, polypropylene, polyamide, polystyrene, acrylonitrile butadiene styrene, polycarbonate, a combination of two or more thereof, and a mixture of two or more thereof. In some other examples, the second layer (112) is laminated to the first fabric layer and has a surface roughness of less than about 5 microns by PPS method on an image side, the second layer comprising one of a non-woven fiber structure that comprises synthetic polymeric fiber within a range of about 10% to about 40% by weight of total fiber and a synthetic polymeric film having a thickness within a range of about 40 microns to about 300 microns;

The second layer (112) of the composite supporting base substrate (110) may further comprise a polymeric binder. The polymeric binder may be pre-mixed with one or both of the synthetic polymeric fiber and the natural fiber, for example. Examples of polymeric binder included in the second layer composition include, but are not limited to, water soluble polymers, such as polyvinyl alcohol, starch derivatives, gelatin, cellulose derivatives, acrylamide polymers; water-dispersible polymers, such as acrylic polymers or copolymers, vinyl acetate latex, polyesters, and styrene-butadiene or acrylonitrile-butadiene copolymer latex; a combination of two or more of the above polymeric binders; or a mixture of two or more of the above polymeric binders. The polymeric binder may have a glass transition temperature (Tg) within a range of about −30° C. to about 10° C. In some examples, the Tg of the polymeric binder is within a range of −25° C. to about 10° C., or −20° C. to about 10° C., or −15° C. to about 10° C., or −10° C. to about 10° C. A ratio of latex resin binder to the natural cellulose fiber in the second layer composition may range from about 1:20 to about 1:1. In some examples, the ratio of latex resin binder to the natural cellulose fiber in the second layer composition ranges from about 1:15 to about 1:1, or about 1:10 to about 1:1, or about 1:5 to about 1:1. Moreover, aqueous coupling agents also may be used in the second layer (112) composition in an amount to improve binding between the fibers. Representative examples of commercially available coupling agents include, but are not limited to, Dow Corning® Z 6032, Dow Corning® Z 6030, and Dow Corning® Z 6040 silanes from Dow Corning, Inc., MI, USA, or Struktol® SCA 98, Struktol® SCA 930, and Struktol® SCA 960 organosilanes from Struktol Company of America, OH, USA.

In some examples, the composite supporting base substrate (110) may further comprise an adhesive compound that is laminated between the first fabric layer (111) and the second fiber layer (112). The adhesive compound can be any adhesive which is able to bonder two materials together with adequate strength. The adhesive may be an aqueous latex adhesive that is selected from a wide variety of resin latex. The resin latex of the adhesive may include, but is not limited to, resins formed by polymerization of hydrophobic addition monomers. Examples of hydrophobic addition monomers include, but are not limited to, C1-C12 alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmthacrylate), carboxylic acid containing monomers (e.g., acrylic acid, methacrylic acid), vinyl ester monomers (e.g., vinyl acetate, vinyl propionate, vinyl benzoate, vinyl pivalate, vinyl-2-ethylhexanoate, vinyl versatate), vinyl benzene monomer, C1-C12 alkyl acrylamide and methacrylamide (e.g., t-butyl acrylamide, sec-butyl acrylamide, N,N-dimethylacrylamide), crosslinking monomers (e.g., divinyl benzene, ethylene glycol dimethacrylate, bis(acryloylamido)methylene), and combinations thereof. Polymers made from one or both of the polymerization and copolymerization of alkyl acrylate, alkyl methacrylate, vinyl esters, and styrene derivatives also may be used. Representative examples of commercially available adhesive products include, but are not limited to, Acronal® 788 or Acronal® 866 from BASF North America; RayCryl® 347 from Specialty Polymers, Inc., OR, USA; and Flexbond® 325 or Flexbond® 825 from Air Products, Inc., PA, USA.

The composite supporting base substrate (110) may further comprise a tie layer (140) applied over the second layer containing fibers (112). Without being linked by any theory, it is believed that this tie layer is able to provide better adhesion between the second layer containing fibers (112) and a subsequent material layer applied to the second layer (112) to form a wall covering, including an image receiving layer, as further described below. The tie layer may be a polymeric material with a surface free energy that is higher than the surface free energy of the synthetic polymeric film, for example a surface free energy that is greater than 30 milliNewton per meter (mN/m), as measure at 20° C. In some examples, the polymeric material of the tie layer has a surface free energy that is greater than 35 mN/m, or greater than 38 mN/m, or greater than 40 mN/m. Examples of polymeric material of the tie layer (140) include, but are not limited to, various polyacrylates, various polymethyacrylates, polyethyleneoxide, polyvinyl alcohol, polyethyleneterephthalate, polyamide, polycarbonate, polystyrene, polychlororopene, polyoxyethylene, polystyrene, poly(2-vinyl pyridine), epoxy resins, a combination of two or more of these materials, or a mixture of two or more of these materials. An amount of the tie layer material on the second layer containing fibers (112) may be within a range of about 0.01 grams per square meter (gsm) to about 5 gsm. In some examples, the amount of the tie layer material applied aver the second layer (112) is within the range of about 0.1 gsm to about 5 gsm, or about 0.3 gsm to about 4 gsm, or about 0.5 gsm to about 3 gsm.

Image Receiving Layer

The printable medium (100) that includes the composite supporting base substrate (110) further includes an image receiving layer (120) coated over the second fiber layer (112) of the composite supporting base substrate. The image receiving layer (120) can also be coated over the tie layer (140) when present. The coat weight of the image receiving layer (120) may range, for example, from about 5 gsm to about 50 gsm or may ranges from about 10 gsm to about 20 gsm. Once coated, the image receiving composition dries to form a layer (i.e., the image receiving layer). In some examples, the thickness of the image receiving layer ranges from about 5 microns (μm) to about 40 microns (μm). In some examples, the image receiving layer (120) has a smooth surface with a PPS smoothness that is less than 1.5 micro (μm) or less than 0.8 micro (μm). It is believed that any surface with roughness greater than this range will results an undesirable image quality like mottling.

In some examples, the image receiving layer (120) contains pigment fillers and polymeric binders. The image receiving layer (120) can also contain pigment fillers, polymeric binders and latex film-forming agents. The pigment fillers can be either inorganic and/or organic particulates, either in solids powder form or in a dispersed slurry form. Examples of inorganic pigment filler include, but are not limited to, aluminum silicate, kaolin clay, a calcium carbonate, silica, alumina, boehmite, mica, talc, and combinations or mixtures thereof. The inorganic pigment filler can include clay or a clay mixture. The inorganic pigment filler can include a calcium carbonate or a calcium carbonate mixture. The calcium carbonate may be one or more of ground calcium carbonate (GCC), precipitated calcium carbonate (PCC), modified GCC, and modified PCC. The inorganic pigment fillers may also include a mixture of a calcium carbonate and clay. In some examples, the inorganic pigment fillers include two different calcium carbonates pigments (e.g., GCC and PCC). Examples of organic pigment filler include, but are not limited to, particles, either existing in a dispersed slurry or in a solid powder, of polystyrene and its copolymers, polymethyacrylates and their copolymers, polyacrylates and their copolymers, polyolefins and their copolymers, such as polyethylene and polypropylene, a combination of two or more of the polymers. The pigments, for the image receiving layer (120), may be chosen from silica gel (e.g., Silojet®703C available from Grace Co.), modified (e.g., surface modified, chemically modified, etc.) calcium carbonate (e.g., Omyajet®B6606, C3301, and 5010, all of which are available from Omya, Inc.), precipitated calcium carbonate (e.g., Jetcoat®30 available from Specialty Minerals, Inc.), and combinations thereof. The pigments can be present in an amount ranging, for example, from about 65 wt % to about 85 wt % of the total wt % of the image receiving layer (120).

The polymeric binder, present in the image receiving layer (120), can be an aqueous based binder. Examples of suitable polymeric binders include polyvinyl alcohol, styrene-butadiene emulsion, acrylonitrile-butadiene latex, or any combinations. Moreover, in addition to the above binders, other aqueous binders can be added including: starch (including oxidized starch, cationized starch, esterified starch, enzymatically denatured starch and so on), gelatin, casein, soybean protein, cellulose derivatives including carboxy-methyl cellulose, hydroxyethyl cellulose and the like; acrylic emulsion, vinyl acetate emulsion, vinylidene chloride emulsion, polyester emulsion, and polyvinylpyrrolidone. Other examples of suitable polymeric binders include aqueous based binders such as polyvinyl alcohol (examples of which include Kuraray poval®235, Mowiol® 40-88, and Mowiol® 20-98 available from Kuraray America, Inc.), styrene-butadiene emulsions, acrylonitrile-butadiene latex, and combinations thereof. The amount of the polymeric binder, that is present in the image receiving layer (120), can represent from about 5 to about 40 parts per 100 parts of pigment filler by dry weight; or can represent from about 10 to about 30 parts per 100 parts of pigment filler by dry weight.

The image receiving layer (120) might further contain a latex film-forming agent. It is to be understood that the film-forming agent may be capable of lowering the elastic modulus of polymer particulates (specifically found in latex inks to be printed on the printable medium) and providing temporary plasticization, which promotes polymer chain motion of the polymer particulates during the film forming process. As such, the polymer particulates are more readily able to coalesce, and therefore the film-forming agent can improve the film-forming properties of the polymer particulates. In some examples, the film-forming agents that are part of the image receiving layer (120), include, citrate compounds, sebacate compounds, ethoxy alcohols, glycol oligomers, glycol polymers, glycol ether, glycerol acetals, anionic, cationic or non-ionic surfactants having a more than 12 carbon backbones (e.g., propylene glycol monoester of C-18 fatty acids and propylene glycol mono oleate (each of which is commercially available under the trade name Loxanol® by BASF Corp), cyclic amides, and combinations thereof. The cyclic amides may be β-lactams (e.g., clavam, oxacephem, cephem, penam, carbapenam, and monobactam), γ-lactams, δ-lactams (e.g., caprolactam and glucarolactam), and combinations thereof. The film-forming agent can be a cyclic amide like lactams such as β-lactam, γ-lactam, and δ-lactam, and mixtures thereof. The latex film-forming agent can also be a γ-lactam. Representative examples of a γ-lactam include N-methyl-2-pyrrolidone, 5-methyl-2-pyrrolidone, and 2-pyrrolidone.

A ratio of the amount of pigment filler to an amount of film-forming agent may be within a range of about 200:1 to about 10:1; or may also be within the range of about 150:1 to about 12:1 or within the range of about 100:1 to about 30:1. In some examples, the image receiving layer (120) comprises pigment filler, an aqueous-based polymeric binder in an amount that ranges from about 5 parts to about 40 parts per 100 parts of the pigment filler by dry weight, and a latex film-forming agent in a ratio of the pigment filler to the latex film-forming agent that is within a range of about 200:1 to about 10:1.

The image receiving layer may further include other additives, e.g., processing aids and property modifiers. Examples of additives that may be incorporated include crosslinking agent, surfactant, defoamer, fixing agent, and/or pH adjuster. The image receiving layer might include from about 1 wt % to about 3 wt % of boric acid as a crosslinking agent, from about 0.5 wt % to about 2 wt % of glycerol, and from about 1 wt % to about 5 wt % of a dye fixing agent (such as, e.g., Locron®P available from Clariant International Ltd). The image receiving layer may also include a defoamer in an amount ranging from about 0.05 wt % to about 0.2 wt % of the total wt % of the image receiving layer. Examples of the defoamer include Foamaster® 1410, 1420, 1430, all of which are available from BASF Corp.

External Layer

The printable medium (100) that has a composite base substrate (110) comprising a first fabric layer (111) and a second fiber layer (112), laminated to the first fabric layer, and an image receiving layer (120) coated on the second layer, The printable medium (100) further comprises an external layer (130). The external layer (130) is applied (i.e. coated) above the image receiving layer on the image side (101) of the printable medium (100).

The external coated layer (130) is configured to protect the printable medium and any image printed thereon from mechanical damage (like rubbing and wearing for examples). The external layer (130) facilitates, for examples, a resistance to mechanical wear of 300 cycles or more of abrasion, as specified in Type II, or higher grade, wall covering specifications. The external layer (130) is coated on the image receiving layer of the printable medium (100) and can be considered as a protective layer having a strong adhesion to printed latex inks (e.g., using inkjet printing). The external layer (130) is configured to form a continuous film layer with high strength against mechanical shearing force and is also configured to interact with ink latex so that ink latex particles and ink colorant can adhere firmly on the coated layer (130) surface. The external coated layer (130) protects an image after image formation. In some examples, the external layer (130) is a non-porous and transparent or semi-transparent layer.

The external coated layer (130) contains, at least, two polymeric networks and polymeric particles. The external layer (130) that is applied to the printable medium includes, at least, a polymeric particle. Such polymeric particles can be considered as organic beads. In some examples, the polymeric particles are poly-alkene compounds. By poly-alkene compound, it is meant herein that the polymeric particle is made, for instance, from a poly-alkene homopolymer, a poly-alkene copolymer, a modified poly-alkene, a combination of two or more of the above-listed poly-alkenes, or a mixture of two or more thereof. By definition, a "poly-alkene" herein refers to a polymeric material formed via polymerization of an alkene monomer, i.e., $C_nH_{2n}$ and its derivatives, where n is within a range of about 7,000 to about 20,000. Examples of the polymers used to make the polymeric particles include, but are not limited to, polyethylene homopolymer, polypropylene homopolymer, polytetrafluoroethylene (PTFE), polyamide, amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, a combination of two or more of the above-listed poly-alkenes, or a mixture of two or more of the above-listed poly-alkenes. The polymeric particles can have a hardness value less than about 2 dmm, as measured by ASTM D-5 method. In some other examples, the particles have a hardness value less than about 1, or less than about 0.5 dmm. In some examples, the particle size of the polymeric particles can be in the range of about 10 to about 40 μm. In some examples, the particles have a hardness value in dmm within a range of about 0.1 to about 2, or about 0.1 to about 1.5.

In some examples, the polymeric particles are polytetrafluoroethylene (PTFE), polyamide or polyethylene polymer particles. In some other examples, the polymeric particles are polytetrafluoroethylene (PTFE), polyamide or polyethylene polymer particles and have an average particle size be in the range of about 10 to about 60 μm. In yet some other examples, the polymeric particles are polyamide polymer particles. The polymeric particles can thus be polyamide particles that have a Vicat softening point ranging from about 100° C. to about 180° C., as measured by the Industrial standard ASTM D1525, and have a melting point ranging from about 100° C. to about 220° C., as measured by the industrial standard ISO3146.

Polymeric particles are rigid and temperature-resistant particles. The "temperature-resistant" refers to the fact that the change in the rigidness will be kept substantially minimal under the fabric manufacture and storage conditions, even if polymeric particles can be made from the thermoplastic and thermoset polymers. In addition, polymeric particles will not change its morphology (such as melting, collapse, and coalescence together) under printing condition. The temperature-resistant of the polymeric particles could be monitored by its softening temperature as defined and measured by the industrial standard ASTM D6493 or ISO 4625. In some examples, the softening temperature of the polymeric particle is greater than 120° C. or in the temperature range of about 130° C. to about 200° C. Without being linked by any theory, with said chemical and physical characteristics, the polymeric particles are thought to provide a high durability (especially high anti-abrasion capability) to the printed image.

The polymeric particles can be present, in the printable medium, in an amount representing more than 1 wt % by total weight of the polymeric components of external layer (130). In some examples, the amount of polymeric particle, in the print medium, can be within the range of about 1 to about 30 wt % or within the range of about 1 to about 20 wt % or within the range of about 1 to about 15 wt % by total weight of the polymeric components of external layer (130) In some other examples, the polymeric particles are present, in the external layer composition, in an amount representing from about 5 to about 15 wt % of the polymeric components of external layer (130).

Other representative commercially available examples of the particles include, but are not limited to; Acumist® micronized polyolefin waxes by Honeywell; Slip-ayd® waxes by Elementis Specialties, and Licowax® waxes by Clariant, Germany. In some examples, the particles are made from a micronized polyalkene compound dispersed in an aqueous solvent. The polymeric particles can be available under the tradename Organsol®2002ES3NAT3 (available from Arkema) or under the tradename Slip-ayd® SL300 (available from Elementis Specialties).

The external layer (130) that is applied to the printable medium further includes, at least, two polymeric networks. The wording "polymer network" refers herein to a polymer and/or a polymer mixture which can be self-cross-linked, by reaction of different function groups in the same molecular chain, or inter-cross-linked by reaction with another compound which has different function group. The two polymeric networks are substantially not reactive each other. The word "substantially" means that the tendency, or reaction speed, of reaction between two polymer networks is minimal comparing with self-cross-linking and inter cross-linking. Under these definitions, the two polymer networks are, at least, partially interlaced on a polymer scale but not covalently bonded to each other. A non-reactive polymer can be added into the individual polymer network to modify physical properties of the polymer network after reaction or curing. The non-reactive polymer can have an identical or similar monomer structure as corresponding polymer network.

In some example, one polymeric network of the external layer (or first polymeric network) is created by using a self-cross linked polyurethane polymer. The self-cross linked polyurethane is formed by reacting an isocyanate with a polyol, where both isocyanates and polyols have average less than three end functional groups per molecule so that the polymeric network is based on a liner polymeric chain structure. The polyurethane chain can have a trimethyloxysiloxane group and cross-link action can take place by hydrolysis of the function group to form silsesquioxane structure. The polyurethane chain can also have an acrylic function group, and the cross-link structure can be formed by nucleophilic addition to acrylate group through acetoacetoxy functionality.

In some other example, one polymeric network of the external layer (or first polymeric network) is created by using vinyl-urethane hybrid copolymer or acrylic-urethane hybrid polymer. In yet some other examples, the first polymeric network includes an aliphatic polyurethane-acrylic hybrid polymer.

Representative commercially available examples of the chemicals which can form first polymeric network include, but are not limited to, NeoPac®R-9000, R-9699 and R-9030 (from Zeneca Resins), Sancure®AU4010 (from Lubrizol) and Hybridur®570 (from Air Products).

The first polymeric network can include a polymeric core that is, at least, one polyurethane. The polyurethanes include aliphatic as well as aromatic polyurethanes. The polyurethane is typically the reaction products of the following components: a polyisocyanate having at least two isocyanate (—NCO) functionalities per molecule with, at least, one isocyanate reactive group such as a polyol having at least two hydroxy groups or an amine. Suitable polyisocyanates include diisocyanate monomers, and oligomers.

Examples of polyurethanes include aromatic polyether polyurethanes, aliphatic polyether polyurethanes, aromatic polyester polyurethanes, aliphatic polyester polyurethanes, aromatic polycaprolactam polyurethanes, and aliphatic polycaprolactam polyurethanes. In some other, the polyurethanes are aromatic polyether polyurethanes, aliphatic polyether polyurethanes, aromatic polyester polyurethanes, and aliphatic polyester polyurethanes.

Representative commercially available examples of polyurethanes include Sancure®2710 and/or Avalure®UR445 (which are equivalent copolymers of polypropylene glycol, isophorone diisocyanate, and 2,2-dimethylolpropionic acid, having the International Nomenclature Cosmetic Ingredient name "PPG-17/PPG-34/IPDI/DMPA Copolymer"), Sancure®878, Sancure®815, Sancure®1301, Sancure®2715, Sancure®2026, Sancure®1818, Sancure®853, Sancure®830, Sancure®825, Sancure®776, Sancure®850, Sancure®12140, Sancure®12619, Sancure®835, Sancure®843, Sancure®898, Sancure®899, Sancure®1511, Sancure®1514, Sancure®1517°, Sancure®1591, Sancure®2255, Sancure®2260, Sancure®2310, Sancure®2725, and Sancure®12471 (all commercially available from Lubrizol Inc.).

In some example, another polymeric network of the external layer, or second polymeric network, is created by using cross-linkable polyglycidyl or polyoxirane resins. Cross-link reaction can take place either with themselves (through catalytic homopolymerisation of oxirane function group) or with the help of a wide range of co-reactants including polyfunctional amines, acids, acid anhydrides, phenols, alcohols, and thiols. Both polyglycidyl resin and co-reactants are compatible with the chemicals which form first polymeric network before curing in liquid state. The term "compatible" refers here to the fact that there is no significant phase separation after mixing in the room temperature.

In some examples, the second polymeric network comprises epoxy-functional additives. Epoxy-functional additives can include alkyl and aromatic epoxy resins or epoxy-functional resins, such as for example, epoxy novolac resin(s) and other epoxy resin derivatives. Epoxy-functional molecules can include at least one, or two or more pendant epoxy moieties. The molecules can be aliphatic or aromatic, linear, branched, cyclic or acyclic. If cyclic structures are present, they may be linked to other cyclic structures by single bonds, linking moieties, bridge structures, pyro moieties, and the like. Examples of suitable epoxy functional resins are commercially available and include, without limitation, Ancarez® AR555 (commercially available from Air Products), Ancarez®AR550, Epi-rez®3510W60, Epi-rez®3515W6, or Epi-rez®3522W60 (commercially available from Hexion).

In some other examples, the second polymeric network includes epoxy resin. Examples of suitable aqueous dispersions of epoxy resin include Waterpoxy® 1422 (commercially available from Cognis) or Ancarez®AR555 1422 (commercially available from Air Products). The second polymeric network can comprise epoxy resin hardeners. The examples of epoxy resin hardeners that can be used herein include liquid aliphatic or cycloaliphatic amine hardeners of various molecular weights, in 100% solids or in emulsion or water and solvent solution forms. Amine adducts with alcohols and phenols or emulsifiers can also be envisioned. Examples of suitable commercially available hardeners include Anquawhite 100 (from Air Products) and EPI-CURE® 8290-Y-60 (from Hexion). The second polymeric network can include water-based polyamine as epoxy resin hardeners. Such epoxy resin hardeners can be, for examples, water-based polyfunctional amines, acids, acid anhydrides, phenols, alcohols and/or thiols In some examples, the printable medium has an external layer that comprises a polymeric network that includes water-based epoxy resin and water-based polyamine as epoxy resin hardeners. In some other examples, the printable medium has an external layer that comprises a first polymeric networks created by using a self-cross linked polyurethane polymer and a second polymeric network created by using cross-linkable polyglycidyl or polyoxirane resins. In yet some other examples, the printable medium has an external layer that comprises a first polymeric network that is created by using vinyl-urethane hybrid copolymer or acrylic-urethane hybrid polymer and a second polymeric network that is created by using water-based epoxy resin and water-based polyamine.

The printable medium (100) has an external layer (130) wherein the ratio of the first polymeric network to the second polymeric network can be ranging from 1:0.05 to 1:1; or can be ranging from 1:0.2 to 1:0.8.

Method for Forming a Printable Medium Substrate

In some examples, according to the principles described herein, a method for forming a printable medium with a composite supporting base substrate (110) having a first fabric layer (111) and a second layer (112), containing fibers, laminated to the first layer; an image receiving layer (120) coated on the second layer; and an external layer (130), coated over the image receiving layer, comprising, at least, two polymeric networks and polymeric particles, is provided. Such printable medium could be a wall covering medium.

FIG. 3 is a flowchart illustrating a method (300) of making the printable medium (100) such as described herein. Such method encompasses providing (310) a first fabric layer (111) and a second layer containing fibers (112); laminating (320) the first fabric layer and the second layer together to form a composite supporting base substrate (110); coating (330) an image receiving layer (120) onto the second layer of the composite supporting base substrate; and coating (340) an external layer (130) onto the image receiving layer. In some examples, the method encompasses laminating an adhesive compound between the first fabric layer (111) and the second layer (112) of the composite supporting base substrate (110). In some other examples, the method encompasses applying a tie layer (140) on the second layer (112), before coating the image receiving layer (120).

The method (300) for forming the printable medium, as described herein, comprises providing (310) a first fabric layer (111) and a second layer (112) in view of forming a composite supporting base substrate (110). The first fabric layer (111) includes any of the above-described fabric materials and structures, including woven, non-woven, knitted or tufted fabric structures. The first fabric layer can be provided, for example, using a textile manufacturing technique.

The second layer containing fibers (112) may include a synthetic polymeric component. The second layer may be a non-woven paper composition that is formed using paper making techniques and paper making equipment. In this example, the second layer containing fibers is formed using a paper making process (the wet forming process), where fibers are suspended in water, brought to a forming unit where the water is drained off through a continuous moving wire or screen and the fibers are deposited on the wire, and then the fibers are picked off the wire to be dried. In order to have a targeted formed web or sheet, the fiber concentration for the non-woven paper composition may be very low, such as less than about 0.5% by weight. Synthetic polymeric fiber used in forming the second layer may not be capable of being self-bonded together, for example with hydrogen bonding as natural wood fiber is. Therefore, an external bonding method is employed with the synthetic polymeric fiber, such as with one or more of a variety of binder types and application methods. For example, a binder may be applied either before web formation or after web formation. After web formation, the binder may be applied by saturation, spraying, printing, foaming, or a combination thereof. After application of the binder, the web may be dried and in some examples, the binder may be activated, with steam heated cans, for example. At the end of the processing line, the web is calendered to densify, smooth, and soften the non-woven paper to achieve a target density and smoothness of the second layer. For example, the target smoothness of no greater than 5 microns by PPS method is achieved with various combinations of calender pressure within a range of about 35 kilograms per square centimeter (kg/cm2) to about 140 kg/cm2 and calender temperature within a range of about 25° C. to about 300° C.

The first and second layers are laminated (320) together using a laminator. In some examples, the first fabric layer (111) and the second layer (112) are fed together at a lamination roll where they are laminated together, and dried in a drying oven or dryer and wound onto a finished roll in order to form the composite supporting substrate (110). In some examples, the second layer (112) is coated with an adhesive compound from an adhesive bath. The adhesive can be coated onto the second layer (112) using a metering rod that can be facilitated by a pick-up roll. The second layer (112) can also be fed to a lamination roll without an adhesive coating. In some examples, a tension within a range of about 60 Newton (N) to about 120 N may be applied to the second layer, and a tension within a range of 80 N to about 160 N may be applied to the first fabric layer using a laminator. In some other examples, the first fabric layer (111) and the second layer (122) are laminated together at the lamination roll at a speed that may range from about 10 meters/minute to 30 meters/minute, and then dried in the dryer using a peak temperature that may range from about 50° C. to about 150° C.

Examples of lamination equipment include, but are not limited to, Talon 64 (152.4 cm wide web) from GBC, Lincolnshire, Ill.; 62 Pro laminating machine (152.4 cm wide web) from Seal, Elkridge, Md.; and lamination machines from Polytype Converting Ltd., Freiburg, Switzerland. Coating and laminating machines may be obtained from Faustel, Germantown, Wis. and Black Clawson Ltd, Newport, South Wales, UK, for example.

The method (300) for forming the printable medium further comprises coating (330) an image receiving layer (120) over the second layer (112) of the composite supporting base substrate (110). The image receiving layer (120) is then dried using one or more a blower, a fan, an infrared lamp, and an oven. The method (300) further comprises coating (340) an external layer (130) onto the image receiving layer (120) using a coater or any applicators. The external layer (130) is then dried using one or both of low temperature heating and air flow. The image receiving layer and the external layer may be coated using applicator including, but not limited to, one or more a spray coater, a spin coater, a slot die applicator, fountain curtain applicator, blade applicator, rod applicator, air knife applicator, or air brush applicator.

A calendering process can then be used to achieve the desired gloss or surface smoothness. Calendering is the process of smoothing the surface of the paper by pressing it between nips formed in a pair of rollers. The rollers can be metal hard roll, and soft roll covered with a resilient cover, such as a polymer roll. The resilient-surface roll adapts itself to the contours of the surface of the substrate and presses the opposite side of substrate evenly against the smooth-surface press roll. Any of a number of calendering devices and methods can be used. The calendering device can be a separate super-calendering machine, an on-line calendaring unit, an off-line soft nip calendaring machine, or the like. In some examples, the calendering is carried out at room temperature. In some examples, the calendering is carried out at a temperature ranging from about 50 to about 150 ° C. (metal roll surface temperature) and, in some other examples, from about 80 to about 110 ° C. The nip pressure can be any value between about 50 to about 500 KN/cm2.

In some examples, the back-side (102) (or non-image side) of the printable medium (100), specifically when used as a wall covering medium, can be pre-applied with an adhesive for adhering to a wall or other surface. In some other examples, the printable medium (100) can be applied on a wall, as a wall covering, using a commercial available adhesive. Examples of commercial wall-adhering adhesives for wall coverings include, but are not limited to, Pro-880 Premium Clear Strippable, Pro-838 Heavy Duty Clear, Pro- 543 Universal, ECO-888 Strippable with Mildew Guard, and Golden Harvest Wheat wallpaper adhesives, all from Roman Decorating Products, IL, USA; Zinsser® Sure Grip®-128 and Zinsser Sure Grip®-132 wallpaper adhesives, both from Rust-Oleum® Corporation, USA; Dynamite® 234, Dynamite® C-11, Dynamite®DEFENDER wallpaper adhesives, each by Gardner-Gibson, FL, USA; Polycell®Paste the Wall wallpaper adhesive from AkzoNobel Group of Companies, UK; ECOFIX adhesive from Ecofix AB, Sweden; and Metylan and Solvite wallpaper adhesives from Henkel, Germany.

Printing Method

The printable medium (100) as described herein can be used in a printing method. The printing method encompasses obtaining a printable medium with a composite supporting substrate having a first fabric layer and a second layer containing fibers laminated to the first layer; an image receiving layer coated on the second layer; and an external layer coated over the image receiving layer, comprising, at least, two polymeric networks and polymeric particles and, then, applying an ink composition onto said printable medium to form a printed image. Said printed image will have, for examples, enhanced image quality and image permanence. The printable medium, as disclosed herein, may be used as a wall covering material (e.g., wallpaper) for home or commercial use, for decoration or display. The printable medium can thus be a printable wall covering medium. The printable medium is specifically designed to receive any inkjet printable ink, such as, for example, organic solvent-based inkjet inks or aqueous-based inkjet inks The ink composition forms an image on the image side of the printable medium or on the image side of wall covering medium.

The ink composition may be deposited, established, or printed on the printable medium using any suitable printing device. In some examples, the ink composition is applied to the printable medium via inkjet printing techniques. The ink may be deposited, established, or printed on the medium via continuous inkjet printing or via drop-on-demand inkjet printing, which includes thermal inkjet printing and piezoelectric inkjet printing. Representative examples of printers used to print on the printable medium or wall covering medium, as defined herein, include, but are not limited to, HP DesignJet printers: L25500, L26500, and L65500; HP Scitex printers: LX600, LX800, LX850, and TurboJet 8600 UV from Hewlett-Packard Company. Representative inkjet inks used by the above-listed printers include, but are not limited to, HP 791, HP 792, and HP Scitex TJ210. The printers may be used in a standard wall paper profile with a production print mode or a normal print mode. The print mode may vary the ink application within a range of from about 50% to about 250% of each other.

Some examples of inkjet inks that may be deposited, established, or otherwise printed on the printable medium include pigment-based inkjet inks, dye-based inkjet inks, pigmented latex-based inkjet inks, and UV curable inkjet inks Additionally, the printable mediums are also designed to receive thereon a solid toner or a liquid toner. The solid toner or the liquid toner may include toner particles made, e.g., from a polymeric carrier and one or more pigments. The liquid toner may be an organic solvent-based (e.g., hydrocarbon) liquid toner. The solid toner or the liquid toner may be deposited, established, or otherwise printed on the examples of the printable medium using, respectively, a suitable dry or liquid press technology, such as a dry toner electrophotographic printing device or a liquid toner electrophotographic printing device.

In some examples, the ink composition is an inkjet ink composition and contains one or more colorants that impart the desired color to the printed message. As used herein, "colorant" includes dyes, pigments, and/or other particulates that may be suspended or dissolved in an ink vehicle. The colorant can be present in the ink composition in an amount required to produce the desired contrast and readability. In some other examples, the ink compositions include pigments as colorants. Pigments that can be used include self-dispersed pigments and non-self-dispersed pigments. Pigments can be organic or inorganic particles as well known in the art. As used herein, "liquid vehicle" is defined to include any liquid composition that is used to carry colorants, including pigments, to a substrate.

In some other examples, the ink composition that is applied to print medium is an ink composition containing latex components. Latex components are, for examples, polymeric latex particulates. Therefore, is some examples, the ink composition contain polymeric latex particulates in an amount representing from about 0.5 wt % to about 15 wt % based on the total weight of the ink composition. The polymeric latex refers herein to a stable dispersion of polymeric micro-particles dispersed in the aqueous vehicle of the ink. The polymeric latex can be natural latex or synthetic latex. Synthetic latexes are usually produced by emulsion polymerization using a variety of initiators, surfactants and monomers. In various examples, the polymeric latex can be cationic, anionic, or amphoteric polymeric latex. In some examples, the latexes are prepared by latex emulsion polymerization and have a weight average molecular weight ranging from about 10,000 Mw to about 5,000,000 Mw. The polymeric latex can be selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers and acrylonitrile-butadiene polymers or copolymers. The latex components are on the form of a polymeric latex liquid suspension. Such polymeric latex liquid suspension can contain a liquid (such as water and/or other liquids) and polymeric latex particulates having a size ranging from about 20 nm to about 500 nm or ranging from about 100 nm to about 300 nm.

EXAMPLES

The raw materials and the chemical components used in the illustrating samples are listed in Table 1.

TABLE 1

| Ingredients | Nature of the ingredients | Supplier |
|---|---|---|
| Hydrocarb ® 60 | Calcium carbonate pigment fillers | Omya NA |
| Hydrocarb ® 90 | Calcium carbonate pigment fillers | Omya NA |
| Acronal ® 866 | styrene-acrylic binder | BASF Corporation |
| Byk-Dynwet ® 800 | silicone-free wetting agent | BYK USA, Inc. |
| BYK ®-024 | VOC-free silicone defoamer | BYK USA, Inc. |
| 2-pyrrolidinone | Film forming agent | Aldrich Inc. |
| Sancure ® AU4010 | Self-Crosslinking aliphatic polyurethane-acrylic network | Lubrizol |
| Sancure ® 2026 | Waterborne Urethane Polymer (Non-reactive polymer) | Lubrizol |
| Ancarez ® AR555 | Waterborne Epoxy Resin (cross-linked polymeric network) | Air Product |

TABLE 1-continued

| Ingredients | Nature of the ingredients | Supplier |
|---|---|---|
| Anquawhite ® 100 | Cross-link agent | Air Product |
| Slip-ayd ® SL 300 | High Melt Polyethylene Wax Dispersion (Polymeric particle) | Elementis Specialties |

Example 1

Preparation of Printable Medium Samples

The illustrating sample 1, in accordance with the principles described herein, is a digital printing media used in wall covering application. Samples 2, 3 and 4, are comparative examples having different external layer. Detailed structures of these samples are shown in table 2. Each sample has a composite support structure (110), an image receiving layer (120) and different external coated layer (130).

The composite supporting substrate (110) comprises a first layer (111) that is a woven fabric having 90% of total fiber count of polyester fibers and 10% of total fiber count of natural cotton fibers, and having a yarn count of 46 by 48. The composite supporting substrate (110) comprises a second layer (112) that is a non-woven fiber having a composition A (a polypropylene film, with a basis weight 170 gsm) comprising 12 wt % of polyethylene fiber, 8 wt % of calcium carbonate filler, 69 wt % of natural cellulose fibers and 11 wt % of other additives such as binder, coupling agent, color dye and optical brightener agent. An adhesive is applied to second layer (112) using a #60 rod; a tension of 75 Newton (N) is applied to the second layer (112) and a tension of 100 N is applied to first layer (111) using a laminator. The first layer (111) and the second layer (112) of the composite supporting substrate (110) are laminated together at a speed of 20 meters/min and dried using a peak temperature of 80° C.

Samples 1, 2, 3 and 4 are coated with an image receiving layer (120) (i.e. coating A) with a coat weight of 12 gsm. The formulation of the image receiving layer (120), i.e. Coating A, is illustrated in Table 3 below. The image receiving layer (120) is prepared in a high shear mixer. The final solids content after mixing is 52% and the viscosity is 180 centipoise (cps) as measured by a Brookfield viscometer at 100 rpm.

TABLE 2

| | Composite Support Structure (110) | | Image | |
|---|---|---|---|---|
| Samples | First Layer (111) | Second Layer (112) | Receiving Layer (120) | External layer (130) |
| Sample 1 | Fabric A 90 gsm | Composition A 170 gsm | Coating A 12 gsm | Coating I 5 gsm |
| Sample 2 Comparative | Fabric A 90 gsm | Composition A 170 gsm | Coating A 12 gsm | Coating II 5 gsm |
| Sample 3 Comparative | Fabric A 90 gsm | Composition A 170 gsm | Coating A 12 gsm | Coating III 5 gsm |
| Sample 4 Comparative | Fabric A 90 gsm | Composition A 170 gsm | Coating A 12 gsm | Coating IV 5 gsm |

TABLE 3

| Image receiving layer (120) - Coating A | |
|---|---|
| Ingredient | Amount (Parts) |
| Hydrocarb ® 60 | 80 |
| Hydrocarb ® 90 | 20 |
| Acronal ® 866 | 15 |
| 2-pyrrolidinone | 1 |
| Byk-Dynwet ® 800 | 0.5 |
| BYK ®-024 | 0.2 |

Different external layers (130), Coatings I to IV, are formulated. Such formulations are illustrated in Table 4 below. Each number expresses the dry amount (in Parts).

The external layers (130), Coatings Ito IV, are prepared by mixing the ingredients at room temperature in a mixing tank with mediate shear speed (50-100 rpm) for 30 minutes. The mixtures are filtered with a 100 mesh screen and left for 1 hour to degas before use.

Coating I to IV are applied to the printable medium samples at a coat weight of 5 gsm over image Receiving Layer (120) (Coating A) with a multi-structured coating. A production coater equipped with Mayer rod application station is used to coat the coating layers with wet-on-dry sequence. Drying is accomplished in an 8 meter hot air drying channel with a total coating speed of 200 meters per minute.

TABLE 4

| External layer (130) | | | | |
|---|---|---|---|---|
| Ingredient | Coating I | Coating II comparative | Coating III comparative | Coating IV comparative |
| Sancure ® AU4010 | 11 | 17 | 0 | 13 |
| Sancure ® 2026 | 14 | 22 | 0 | 16 |
| Ancarez ® AR555 | 18 | 0 | 24 | 20 |
| Anquawhite ® 100 | 18 | 0 | 24 | 20 |
| Slip-ayd ® SL 300 | 11 | 17 | 23 | 0 |
| Hydrocarb H60 | 28 | 44 | 59 | 66 |

Example 2

Samples Performances

Samples 1 and Comparison Samples 2, 3 and 4 are evaluated according to an industrial standard for durable wall coverings known as ASTM F793, "Standard Classification of Wall Covering by Use Characteristic" (version 2010 substantially followed Federal Specification CCC-W-408D), which defines the durability requirements of wall coverings from "decorative" wall coverings (Category I) to more stringent use cases defined as "commercial serviceability" wall coverings Type I (Category IV), Type II (Category V), Type III (Category VI) and up to "Type IV".

Samples 1 and Comparison Samples 2, 3 and 4 are printed using an HP DesignJet L26500 printer equipped with HP 792 latex inks, using a six color process at 110° C. and at a speed of 100 square feet per hour (a 10 pass bidirectional color profile). An image is created on each Sample with an equal percentage of each of the six ink colors. A final visual appearance of the image is a grey-looking area on the Samples. Per ASTM F793, the image included many different colors. The printed mediums are then evaluated for different performances: Scrubbability, Abrasion, stain removal performances and image quality.

The scrubbability test (solvent resistance), in accordance with ASTM F793, is performed by exposing the various Samples to be tested, to a nylon bristle brush and detergent solution (made in accordance with "Note 1" under section 7.4.1 of ASTM F793) in a BYK Abrasion Tester (from BYK-Gardner USA, Columbus, Md.) with a linear, back-and-forth action, attempting to wear down the image side of the Samples (300 cycles of a nylon brush over a printed surface, wet with trisodium-phosphate based cleaning solution). After the test is concluded, the Samples are rated "pass" or "fail" according to the guidelines listed in 7.7.2 and the visual rating criteria listed in 7.4.2 of ASTM F793. Any "visual difference" in the printed surface fails the test (score equal or below 3), If there is no difference, then the sample passes (score 4-5).

The Stain test is evaluated according to the ASTM F793 method (section 7.5.1) that directs to lay specimens horizontally with decorative surface upwards. 12 reagents are placed onto the surface, covered with a watch glass, and then removed after 24 hrs. Each spot is visually rated. The passing criteria are stated as "there shall be no evidence of appreciable change to the decorative surface". The "stain rating handbook" is used to facilitate the visual ranking, thereby defining a 1-5 ranking system in which the rating from 1 to 3.5 are considered a "FAIL", and from 4 to 5 are considered to be a "PASS". To meet ASTM F793 Type II criteria, the sample must have a PASS ranking for all 12 reagents. The reagents as listed in ASTM F793 are: DI water 18.3 degrees Celsius to 23.8 degrees Celsius, DI water 46.1 degrees Celsius to 51.6 degrees Celsius, EtOH, Vinegar, 3%, Alkali solution, HCl, 5%, Soap solution, Pure orange juice, Butter, Catsup, Tea.

Image quality is evaluated using both numeric measurement method and visual evaluation method. The first method involves printing standardized diagnostic images onto the said printing media, then numerically measuring gamut/color saturation, ink bleed, coalescence, text clarity, ink dry time, and gloss level, using spectrophotometer (such as the X-Rite i1/i0) and single-angle gloss-meter (such as the BYK Gloss-meter). Visual evaluations are done in a light box under standard lighting conditions, such as D65 (6500K), with the image at a known distance & viewing angle. The attributes under visual evaluation are color gamut, area fill uniformity for defects such as coalescence, mottle grain.

Abrasion is evaluated according to ASTM F793 v2010 wall paper standard. It involves cutting a 3"×10" printed sample and fixing into a Wyzenbeek abrasion tester. The cut sample is attached to be under constant tension, and subsequently contacted with a wet/dry sand paper abradant under constant force. The tester is turned on, and the abradant moves in a cyclic fashion with respect to the fixed printed sample. After 300 cycles, the test concludes and the printed sample is inspected for wearing through the "coating layer" into the "backing layer". If there is wearing into the backing layer (score<=3), the sample fails, otherwise passes (score 4-5).

The results of these tests are expressed in Table 5 below. Each testing item is given a rating score according to a 1 to 5 scale, wherein 1 means the worst performance and 5 represents the best performance.

TABLE 5

| Test Results | Sample 1 | Sample 2 Comparative | Sample 3 Comparative | Sample 4 Comparative |
|---|---|---|---|---|
| Image quality | 5 | 5 | 5 | 5 |
| Scrubbability | 5 | 5 | 4 | 3 |
| Abrasion | 5 | 3 | 5 | 5 |
| Stain resistance | 5 | 2.5 | 3 | 5 |

The invention claimed is:

1. A printable medium comprising:

a. a composite supporting substrate comprising:

i. a first fabric layer; and ii. a second layer, containing fibers, laminated to the first layer, b. an image receiving layer coated on the second layer;

c. and an external layer, coated over the image receiving layer, comprising, at least, two polymeric networks and polymeric particles.

2. The printable medium of claim 1 wherein the first fabric layer of the composite supporting substrate comprises natural fibers and synthetic fibers in a woven structure and wherein the amount of natural fibers is about 10% of a total fiber amount and the amount of synthetic fibers is about 90% of the total fiber amount.

3. The printable medium of claim 1 wherein the second layer contains a synthetic polymeric fiber as a first constituent material and a natural cellulose fiber as a second constituent material, the amount of synthetic polymeric fiber in the fiber composition is within a range of about 5% to about 80% by weight of total fibers.

4. The printable medium of claim 1 wherein the composite supporting base substrate further comprise an adhesive compound laminated between the first layer and the second layer.

5. The printable medium of claim 1 wherein the composite supporting base substrate comprises a tie layer applied over the second layer containing fibers.

6. The printable medium of claim 1 wherein the image receiving layer comprises pigment fillers, polymeric binders and latex film-forming agents.

7. The printable medium of claim 1 wherein the polymeric particles of the external layer are poly-alkene compounds.

8. The printable medium of claim 1 wherein the polymeric particles of the external layer are polytetrafluoroethylene, polyamide or polyethylene polymer particles.

9. The printable medium of claim 1 wherein one polymeric network of the external layer comprises a self-cross linked polyurethane polymer.

10. The printable medium of claim 1 wherein one polymeric network of the external layer comprises vinyl-urethane hybrid copolymer or acrylic-urethane hybrid polymer.

11. The printable medium of claim 1 wherein one polymeric network of the external layer comprises cross-linkable polyglycidyl or polyoxirane resins.

12. The printable medium of claim 1 wherein one polymeric network of the external layer comprises water-based epoxy resin and water-based polyamine.

13. The printable medium of claim 1 wherein the external layer comprises a first polymeric network that comprises a self-cross linked polyurethane polymer, and a second polymeric network that is created by using cross-linkable polyglycidyl or polyoxirane resins.

14. The printable medium of claim 1 wherein, in the external layer, the ratio of the first polymeric network to the second polymeric network ranges from 1:0.05 to 1:1.

15. A method for forming a printable medium comprising:

a. providing a first fabric layer and a second layer containing fibers;

b. laminating said first layer and said second layer together to form a composite supporting base substrate;

c. coating an image receiving layer onto the second layer containing fibers;

d. and coating an external layer comprising, at least, two polymeric networks and polymeric particles, onto the image receiving layer.

* * * * *